United States Patent [19]

Kawanabe

[11] Patent Number: 4,712,072

[45] Date of Patent: Dec. 8, 1987

[54] TIMER APPARATUS

[75] Inventor: Tetsuya Kawanabe, Tokyo, Japan

[73] Assignee: Canon Kabushiki Kaisha, Tokyo, Japan

[21] Appl. No.: 792,493

[22] Filed: Oct. 28, 1985

[30] Foreign Application Priority Data

Oct. 30, 1984 [JP] Japan ..... 59-226647

[51] Int. Cl.[4] ..... G06M 3/02; G06M 3/08

[52] U.S. Cl. ..... 328/130.1; 340/309.4; 307/141; 307/596; 377/20; 328/75; 368/108

[58] Field of Search ..... 307/592–597, 307/269, 141; 328/72, 73, 75, 86, 129.1, 130.1; 368/108; 340/309.15, 309.4; 377/20; 364/143, 144, 145

[56] References Cited

U.S. PATENT DOCUMENTS

| | | | |
|---|---|---|---|
| 3,657,571 | 4/1972 | Martin et al. | 307/592 |
| 3,909,620 | 9/1975 | Matsuda et al. | 328/72 |
| 4,068,179 | 1/1978 | Sample et al. | 307/596 |
| 4,081,754 | 3/1978 | Jackson | 340/309.4 |
| 4,127,823 | 11/1978 | Frost | 328/75 |
| 4,168,525 | 9/1979 | Russell | 307/596 |
| 4,206,612 | 6/1980 | Gardner | 340/309.4 |
| 4,390,965 | 6/1983 | Albert | 340/309.4 |
| 4,429,278 | 1/1984 | Steinlein | 328/129.1 |

*Primary Examiner*—John S. Heyman

*Attorney, Agent, or Firm*—Fitzpatrick, Cella, Harper & Scinto

[57] ABSTRACT

A timer apparatus which can simultaneously process a plurality of timer service requests of a plurality of control units by a single timer. This timer apparatus includes a timer for counting a clock pulse, a circuit for setting different times having a constant period from different termials and an output circuit for outputting a signal to the terminal at which the time was set from the corresponding terminal when the time coincides with a time signal output from the timer.

5 Claims, 6 Drawing Figures

TIMER APPARATUS

BACKGROUND OF THE INVENTION

1. Field of the Invention

The present invention relates to a timer apparatus and, more particularly, to a timer apparatus in which a plurality of timer service requests are simultaneously processed by single timer means.

2. Description of the Prior Art

The timer function is indispensable to the time control of every apparatus. For example, the timer function is indispensable to control the excitation of each phase of a pulse motor; to monitor the timing of a communication protocol in on-line communication; or to control a paper feed sequence, exposure development sequence or the like of a copying machine. At the present time almost all of those apparatuses are controlled by way of a one-chip CPU and one or two timer means are ordinarily included in this one-chip CPU. However, in actuality the timer means included in the CPU is fairly insufficient because use of the time function is very frequently requested. Therefore, these requests are met be effecting the timer means as if it has pseudo-timer multifunctions.

FIGS. 1A and 1B show conventional methods of realizing pseudo-timer multifunctions. FIG. 1A is a diagram showing the method whereby a single timer means is used in a time-sharing manner. For example, there is a certain apparatus including control units 2 to 5 each having a special function and these units commonly use a timer 1 to perform the time control. Such a time control method is popular. According to the time-sharing method, for instance, when the control unit 2 outputs a trigger signal TG to the timer 1, the timer 1 is used only for a control unit 2 and the other control units 3 to 5 cannot use the timer 1 until a time-out signal TO is outputted to the control unit 2. Consequently, this constitution can be actually used only for the control of a limited purpose and it needs complicated management and control such as determination of the control unit priority when the timer is used, and the like.

FIG. 1B is a diagram showing the case where the timer function is seemingly distributed and each control unit has the pseudo-timer function. Clock means 6 may be an oscillator and, in many cases, is constituted by a timer service process to generate a clock signal at a regular interval (e.g., 5 msec) by using a timer including a CPU therein. In this case, each of control units 7 to 10 has timer means (for example, a counter and a comparator) and allows an independent set value to be held in the counter in response to generation of a request for the timer service. Therefore, whenever a service request is generated from the clock means, the content of each counter is decreased by "1", so that each of the control units 7 to 10 is allowed to make its own timer means operative simultaneously. This constitution, therefore, has various uses. However, when the clock means 6 is in the timer service of the CPU, the service interval inevitably becomes long, so that a high-speed and high-accuracy timer function cannot be expected. On one hand, if such constitution is realized by hardware, each of the control units 7 to 10 must be equipped with the corresponding timer hardware, resulting in an increase in size cost of the apparatus.

SUMMARY OF THE INVENTION

It is an object of the present invention to provide a timer apparatus which can perform the timer service from a plurality of terminals by single timer means.

Another object of the invention is to provide a timer apparatus which can perform the timer service for a plurality of control means at a plurality of different times.

DETAILED DESCRIPTION OF PREFERRED EMBODIMENTS

An embodiment suitable for the present invention will now be described in detail hereinbelow with reference to the drawings.

Figure 1A:
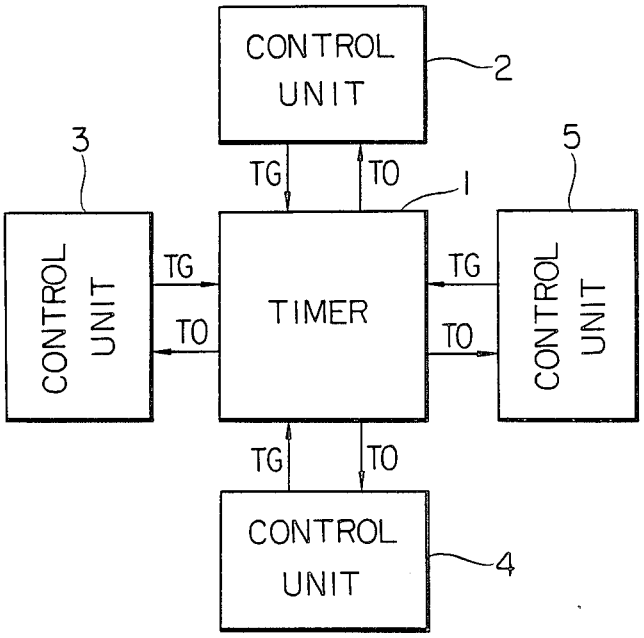
FIG. 1A is a diagram showing a conventional method whereby a single timer means is used in a time-sharing manner.
Figure 1B:
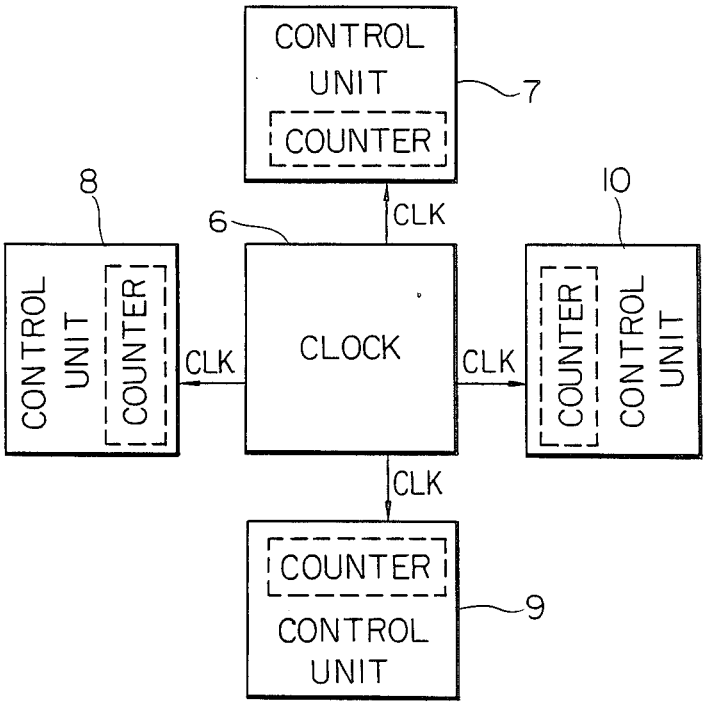
FIG. 1B is a diagram showing a conventional method whereby a plurality of control units have pseudo-timer functions distributed.
Figure 2:
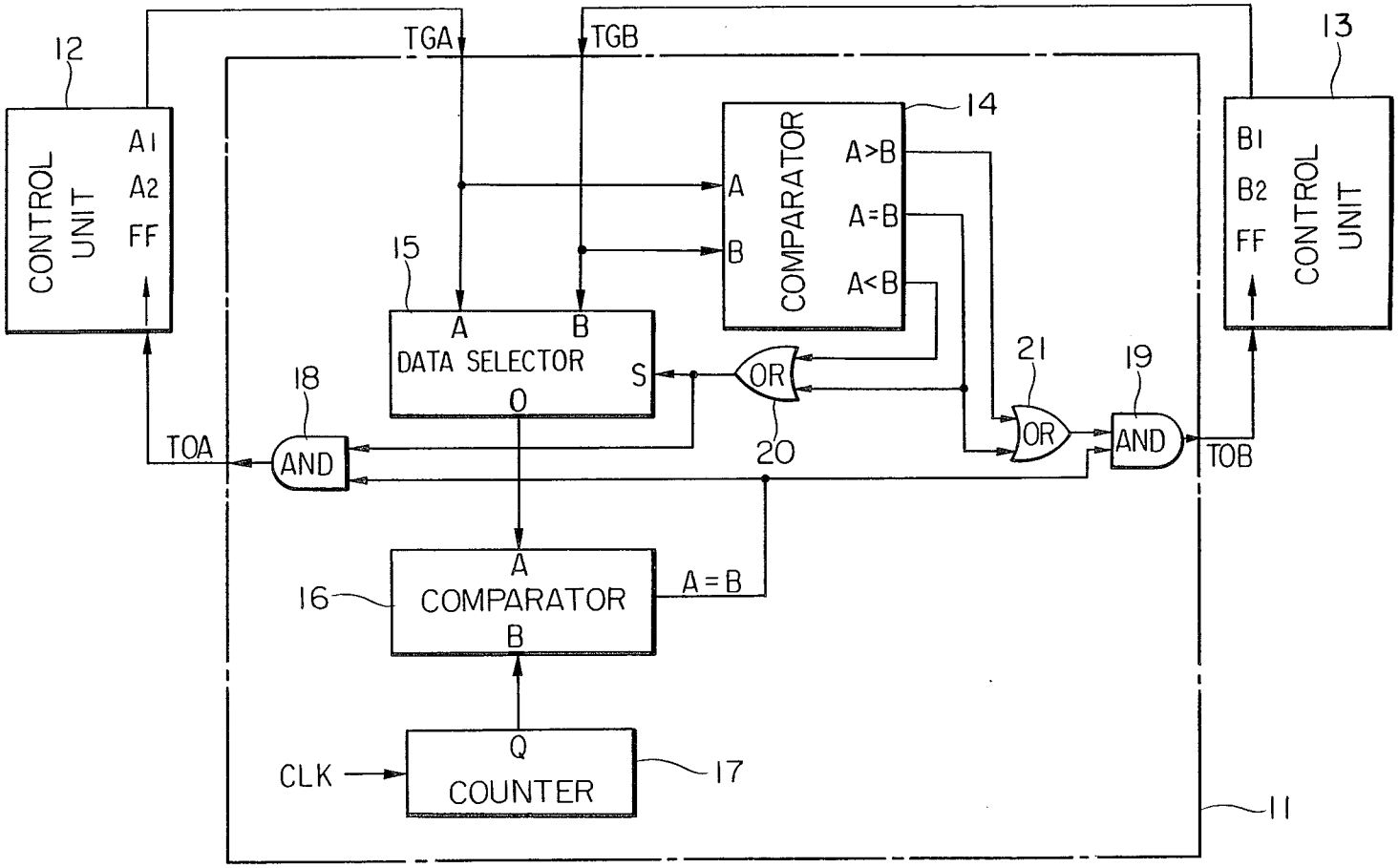
FIG. 2 is a circuit diagram of the first embodiment of the present invention in the case where timer service request data is given as a time.
Figure 3:
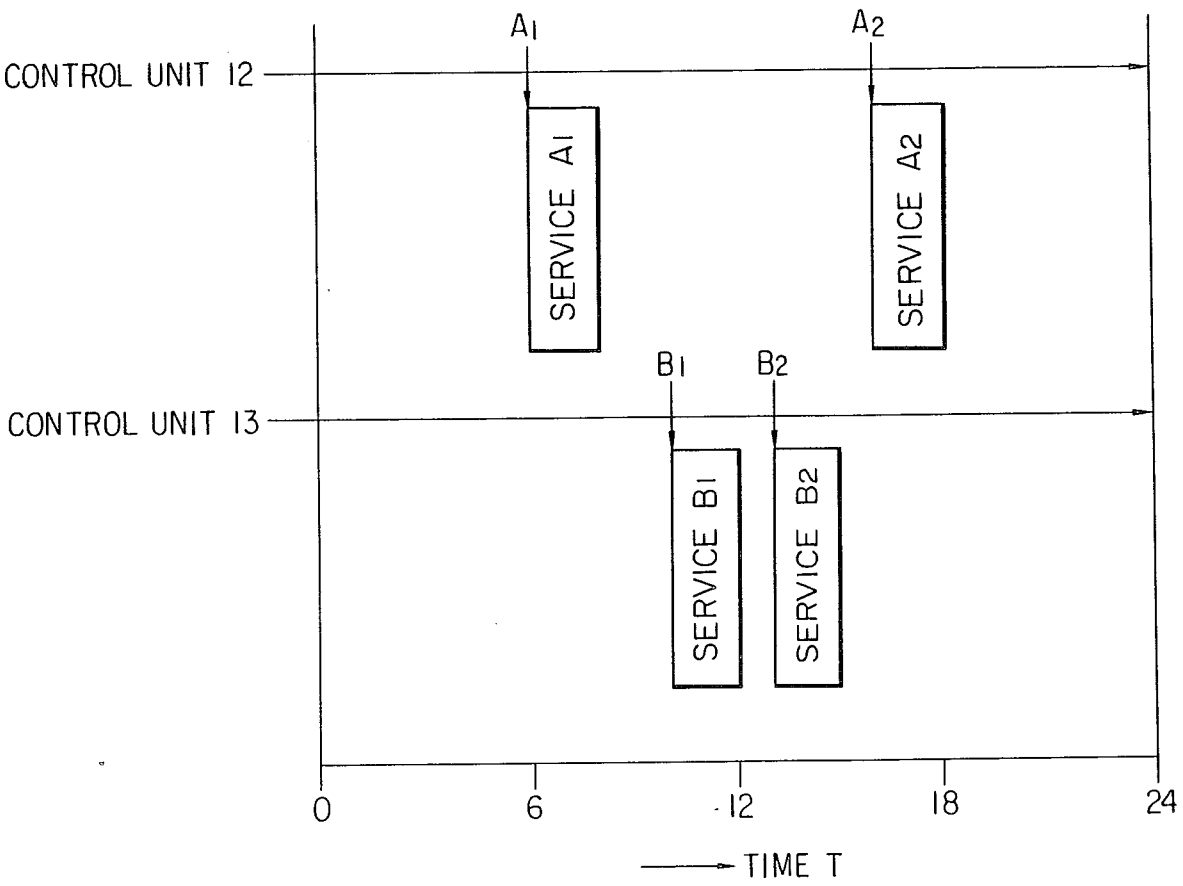
FIG. 3 is a timing chart showing the operation of FIG. 2.

In general, the format of a timer service request depends on the control purpose of a control unit and is not uniform. FIG. 2 shows a circuit diagram of the first embodiment in the case where a timer service request data is given as a time. FIG. 3 is a timing chart showing the operation of FIG. 2. In FIG. 2, reference numeral 11 denotes a timer apparatus of the first embodiment; 12 is one control unit which uses the timer apparatus 11; and 13 is the other control unit. The control unit 12 has, for example, time data $A_1$, $A_2$, . . . to request time services and first receives a time-out signal TOA from the timer apparatus 11 at time $A_1$ and executes a specified control. Next, the control unit 12 outputs the time data $A_2$ to a TGA and waits for the time-out signal TOA. On one hand, the control unit 13 likewise has its own time data $B_1$, $B_2$, . . . and first receives a time-out signal TOB from the timer apparatus 11 at time $B_1$ and executes a specified control. Then, the control unit 13 outputs the time data $B_2$ to a TGB and waits for the time-out signal TOB. The timer apparatus 11 processes such timer service requests from a plurality of control units 12 and 13 by single timer means and allows these requests to be simultaneously processed.

In FIG. 3, when it is assumed that one period is, for example, twenty-four hours, the control unit 12 has service requests at six o'clock and four o'clock. The control unit 13, on one hand, has service requests at ten o'clock and one o'clock. The operation of FIG. 2 will be described hereinbelow with reference to the timing chart. First, the control unit 12 outputs the time data $A_1$ to the TGA and the control unit 13 outputs the time data $B_1$ to the TGB, respectively. A comparator 14 compares the data $A_1$ with the data $B_1$ and outputs a high-level signal to an output terminal $A<B$. A data selector 15 selects the side A of a data input terminal in response to that high-level signal and outputs the data $A_1$ to an output terminal 0. On the other hand, a counter 17 counts a time T and a high-level signal is provided at an output terminal A=B of the comparator 16 is output when $T=A_1$. In this state, a high-level signal is outputted from an OR gate 20 since the high-level signals are outputted from the output terminals A<B of the comparator 14. Thus, the time-out signal TOA is generated from an AND gate 18. On the contrary, a high-level signal is not generated from an OR gate 21. Thus, a low-level signal is generated from an AND gate 19 and the control unit 13 does not operate.

Since the control unit 12 receives the time-out signal of $A_1$, it executes the specified control to be carried out at that time point and then outputs the data $A_2$ to the TGA. On the other hand, the control unit 13 still waits for the time-out signal of $B_1$. Therefore, the comparator 14 then outputs a high-level signal to the output terminal A>B, so that a high-level signal is generated from the OR gate 21. The data selector 15 contrarily selects the data $B_1$ on the side B and outputs a high-level signal to an output terminal A=B of a comparator 16 when $T=B_1$. In this state, only the AND gate 19 is satisfied, so that the time-out signal TOB is generated to the control unit 13. The control unit 13 subsequently executes the specified control and then outputs the data $B_2$ to the TGB. Similarly, since $B_2<A_2$, the control unit 13 will next receive the timer service. Then, the control unit 13 outputs a FF (maximum value) signal so that it does not receive timer service. Therefore, it is the control unit 12 that will next receive timer service. When the $A_2$ signal is generated soon, the control unit 12 also generates an FF signal and the timer service is finished.

No problem will be caused even if the control units 12 and 13 output the same data to the TGA and TGB. This is because the output level of the output terminal A=B of the comparator 14 becomes high and both control units 12 and 13 can simultaneously receive timer service.

Figure 4:
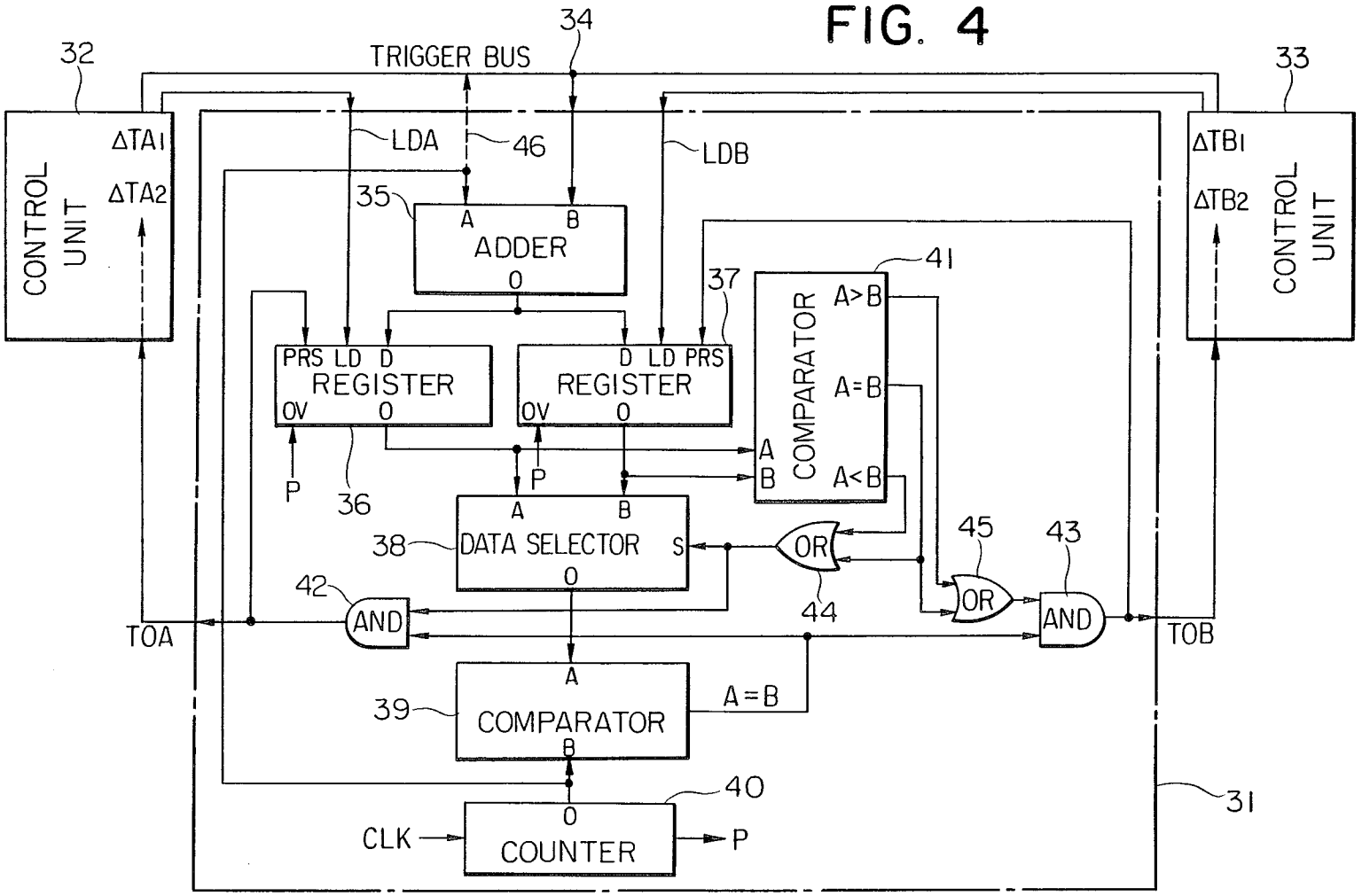
FIG. 4 is a circuit diagram of the second embodiment of the invention in the case where a timer service request data is given as a time period.
Figure 5:
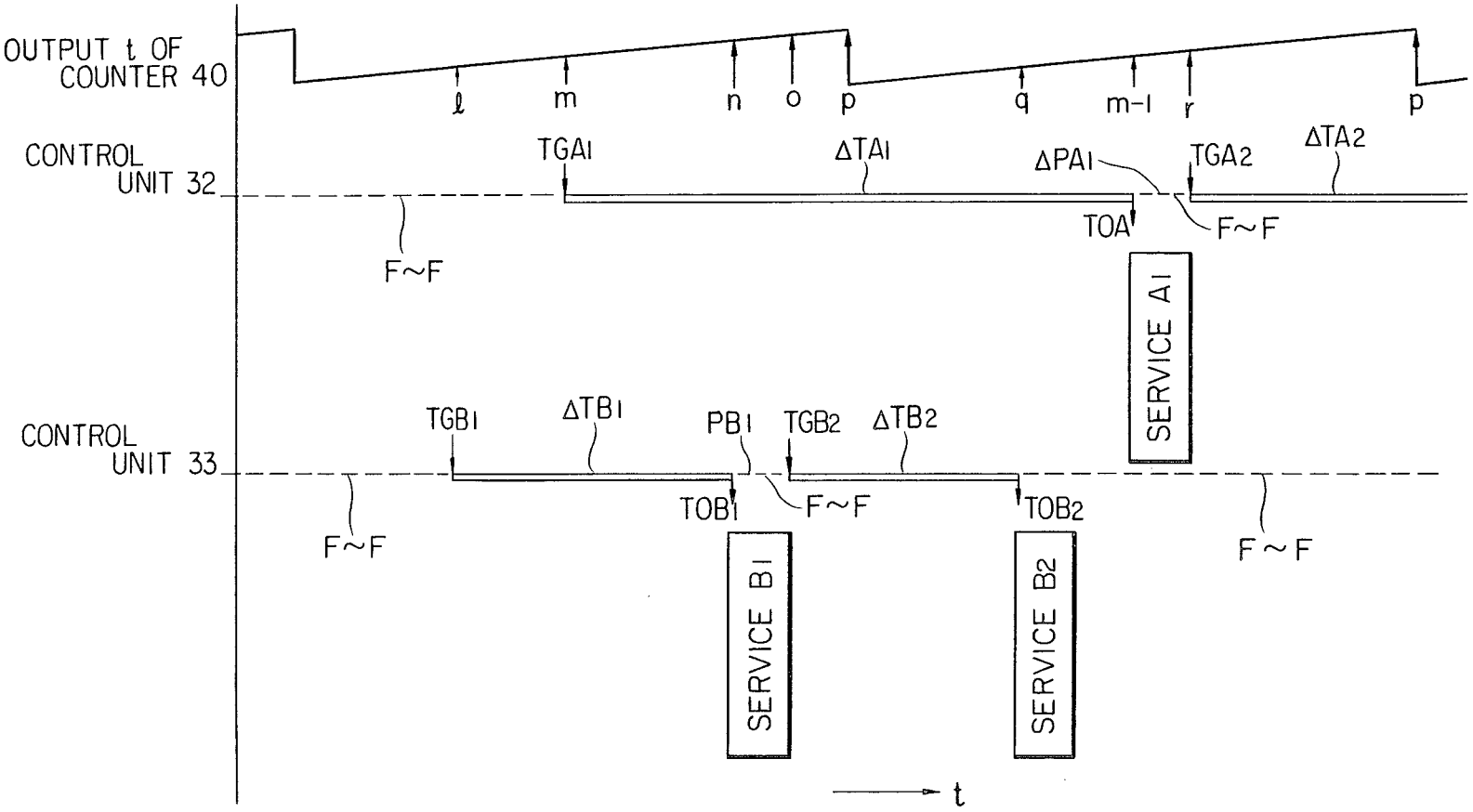
FIG. 5 is a timing chart showing the operation of FIG. 4.

FIG. 4 shows a circuit diagram of the second embodiment in the case where a timer service request is given as a time period. FIG. 5 is a timing chart showing the operation of FIG. 4. The constitution of FIG. 4 differs from that of FIG. 2 since control units 32 and 33 have time period values ΔT as timer service request data. Such a request format is popular in many control units.

In FIG. 5, when a service request after an expiration of a timer period $\Delta TB_1$ is generated from the control unit 33 at a certain timing, a timer apparatus 31 starts timer service. When a service request after an elapse of a timer period $\Delta TA_1$ is generated by the control unit 32 at a certain timing during execution of the service, the timer apparatus 31 allows both timer services to proceed simultaneously by single timer means. When the first timer period $\Delta TB_1$ has elapsed, the time-out signal TOB is outputted to the control unit 33 and timer service of $\Delta TA_1$ is continued as it is. In this state, when timer service of $\Delta TB_2$ is again requested from the control unit 33, the timer service of $\Delta TB_2$ is proceeded in parallel with timer service of $\Delta TA_1$. As will be understood from the diagram, the time-out time of $\Delta TB_2$ is earlier than the time-out time of $\Delta TA_1$; therefore, the timer apparatus 31 outputs the time-out signal TOB to the control unit 33 in a manner similar to the above and subsequently continues timer service of $\Delta TA_1$. In this way, when the time period $\Delta TA_1$ has elapsed, the time-out signal TOA is generated to the control unit 32.

The operation of FIG. 4 will be explained hereinbelow with reference to a timing chart of FIG. 5. In FIG. 4, the control unit 33 outputs the trigger data $\Delta TB_1$ to a trigger bus 34 at a certain timing. A plurality of control units can be connected to the trigger bus 34. Each control unit drives the bus 34 by means of a three-state device. The data $\Delta TB_1$ is inputted to the side B of an adder 35. A count output of a counter 40 is inputted to the side A of the adder 35. Therefore, assuming that the count value of the counter 40 is 1 at this time point, the result of the addition is $1+\Delta TB_1=n$. This result n of the addition is set into a register 37 by a load signal LDB from the control unit 33. On one hand, a register 36 is forcedly set to the maximum valve (F~F) due to initialization. Thus, a high-level signal is out-putted at an output terminal A>B of an comparator 41 and a data selector 38 selects an output of the register 37. A high-level signal is outputted at an output terminal A=B of a comparator 39 when the count value t=n. When the count value is m while a counter 40 counts from 1 to n, the control unit 32 outputs the trigger data $\Delta TA_1$ to the bus 34. The adder 35 adds the count value m at this time point and the data $\Delta TA_1$ (p in the diagram). The value m−1 of the result of the addition and an addition overflow bit OV are set into the register 36 by a load signal LDA. The counter 40 counts in a cycle of count (P+1), so that timer service can be executed by setting the maximum value of the trigger data ΔT to p. The comparator 41 decides such that m−1>n since the overflow bit OV is set in the register 36 and still outputs a high-level signal at the output terminal A>B. Therefore, when an output to of the counter 40 equals n, it outputs a time-out signal $TOB_1$, so that the control unit 33 can receive timer timer service. An output of the AND gate 43 is inputted to a preset terminal PRS of the register 37, thereby forcedly setting the content of the register 37 to F~F and temporarily disabling it. The control unit 33 receives timer service and executes the specified control. The period of time required for this control and the period of time required to request the next trigger are generally peculiar to each control unit and can be preliminarily known. These time periods correspond to the time period $\Delta PB_1$ until the retrigger is performed. The control unit 33 regenerates a trigger data $\Delta TB_2$ when the output of the counter 40 is 0. If it is intended that, for example, the timer services are generated at the same period, the value of $\Delta TB_2$ can be derived by $\Delta TB_1-\Delta PB_1$. In this case, the apparatus can be more accurately controlled by reading the output of the counter 40 through, e.g., a line 46 shown by a broken line. At this time point, the output of the adder 35 is $0+\Delta TB_2=q$ and is provided with the overflow bit OV. Therefore, even if the count value of the counter 40 increases to p, a high-level signal is not generated at the output terminal A=B of the comparator 39. When the counter 40 counts p, it becomes 0 by the next clock CLK. The overflow bits OV of the registers 36 and 37 are respectively reset by the trailing edge of the output of the count value p. This is because both registers are updated to the new count cycles. Therefore, the comparator 41 simply compares the outputs of the registers 36 and 37 and generates a high-level signal at the output terminal A>B at the next time point since q<m−1. When the output of the counter 40 becomes q, it coincides with the output q of the data selector 38, so that the time-out signal TOB is generated from an AND gate 43. Thereafter, the control unit 33 does not generate a trigger data since the next service is not requested.

Therefore, the register 37 is still preset to F~F by an output of the AND gate 43. The comparator 41 outputs a high-level signal at an output terminal A<B at this time point. When the output of the counter 40 becomes m−1, it coincides with the output m−1 of the data selector 38, so that the time-out signal TOA is generated to the control unit 32 through an AND gate 42. At this time, the control unit 32 first receives the trigger data $\Delta TA_1$. After completion of the execution of timer service of $\Delta TA_1$, the control unit 32 outputs the trigger data $\Delta TA_2$ to the bus 34 and waits for the next time-out signal TOA.

Although the case where two independent control units are provided has been described, a single control unit may be provided. The present invention can be also applied even in the case where single control unit outputs complicated and overlapping timer service requests.

As described above, according to the present invention, a plurality of control units can efficiently use a single timer means and their uses are not restricted with one another. Moreover, they can receive accurate timer services and can be used with extreme ease.

What we claim is:

1. A timer apparatus comprising:

a plurality of control means for requesting timer services;

data selecting and comparing means coupled to said plurality of control means which upon receiving control means requests, compares them and priortizes the timer services according to an ordered hierarchy of time determined from said plurality of control means and provides a data output and a first control signal, respectively;

timer means for providing timing data according to a time period;

comparator means for comparing data from said selecting and comparing means and providing a second control signal with data from said timer means; and output means for outputting a signal to respective control means to execute control means services upon coincidence of the first and second control signals from said comparator means and said data selecting and comparing means, respectively.

2. A timer apparatus according to claim 1, wherein said timer means has a counter for counting a clock pulse.

3. A timer apparatus comprising:

a plurality of control means for requesting different hour timer services;

data selecting and comparing means coupled to said plurality of control means which upon receiving control means requests, compares them and priortizes the timer services according to an ordered hierarchy of hours of the day determined from said plurality of control means and provides a data output and a first control signal, respectively;

timer means for providing timing data according to the hour of the day;

comparator means for comparing the data from said data selecting and comparing means with the data from said timer means and providing a second control signal; and output means for outputting a signal to respective control means to execute control means service upon coincidence of the first and second control signals from said comparator means and said data selecting and comparing means, respectively.

4. A timer apparatus according to claim 3, wherein said timer means has a counter for counting a clock pulse, wherein the time of day is determined as a function of the clock pulse.

5. A timer apparatus according to claim 4, wherein said clock pulse has a constant period.

* * * * *